US007124745B2

(12) United States Patent
Glassburn

(10) Patent No.: US 7,124,745 B2
(45) Date of Patent: Oct. 24, 2006

(54) FUEL INJECTION SYSTEM FOR TWO-CYCLE ENGINES

(76) Inventor: Steven Scott Glassburn, 1346 Whitacre Dr., Clearwater, FL (US) 33764

( * ) Notice: Subject to any disclaimer, the term of this patent is extended or adjusted under 35 U.S.C. 154(b) by 0 days.

(21) Appl. No.: 11/249,242

(22) Filed: Oct. 13, 2005

(65) Prior Publication Data

US 2006/0090716 A1 May 4, 2006

Related U.S. Application Data

(60) Provisional application No. 60/623,726, filed on Oct. 29, 2004.

(51) Int. Cl.
*F02M 37/04* (2006.01)

(52) U.S. Cl. ..... 123/497; 123/456

(58) Field of Classification Search ..... 123/497, 123/458, 514, 463, 456
See application file for complete search history.

(56) References Cited

U.S. PATENT DOCUMENTS

| | | | | |
|---|---|---|---|---|
| 3,949,713 | A * | 4/1976 | Rivere | 123/458 |
| 4,221,192 | A * | 9/1980 | Badgley | 123/456 |
| 4,481,926 | A * | 11/1984 | Miki et al. | 123/463 |
| 4,800,859 | A * | 1/1989 | Sagisaka et al. | 123/497 |
| 4,852,529 | A * | 8/1989 | Vowles | 123/143 B |
| 4,957,089 | A * | 9/1990 | Morikawa | 123/486 |
| 5,085,193 | A * | 2/1992 | Morikawa | 123/458 |
| 5,448,977 | A * | 9/1995 | Smith et al. | 123/478 |
| 6,568,372 | B1 * | 5/2003 | Kanno | 123/491 |

* cited by examiner

*Primary Examiner*—Carl S. Miller
(74) *Attorney, Agent, or Firm*—Dennis G. LaPointe

(57) ABSTRACT

A fuel injection system for two-cycle engines comprising high pressure fuel injectors adapted to be installed in a two-cycle gas engine assembly.

6 Claims, 1 Drawing Sheet

FUEL INJECTION SYSTEM FOR TWO-CYCLE ENGINES

RELATED APPLICATION

This application claims the benefit of U.S. provisional application Ser. No. 60/623,726 filed Oct. 29, 2004.

FIELD OF THE INVENTION

The invention relates to the use of a fuel injection system for two-cycle engines as an original equipment manufactured component or as a kit for retrofitting such engines.

BACKGROUND OF THE INVENTION

By utilizing fuel injection instead of traditional carburetion, one is able to increase power output, improve fuel economy and lower emission outputs in automobile engines. What is needed is a fuel injection system that can also be supplied as part of a conversion kit or installed as part of original manufactured equipment in two-cycle engines.

SUMMARY OF THE INVENTION

The present invention is an engine control system developed for two-cycle reciprocating engines used to power various types of motor vehicles or equipment. As mentioned above, by utilizing fuel injection instead of traditional carburetion, we are able to increase power output, improve fuel economy and lower emission outputs. The system developed is adapted for installation and use with various displacement engines with various piston/cylinder configurations. It is anticipated that this system will be installed in newly developed engines or installed as a conversion kit in existing carbureted engines.

Typical components of this system comprise, but are not limited to, the following components:

a. High Pressure fuel injectors to inject fuel into intake runners, manifolds and or cylinders;

b. High Pressure fuel pump designed to accommodate fuel injectors of various design and numbers;

c. Fuel Pressure regulator to set and vary fuel pressures as necessary;

d. Fuel lines to allow transfer of fuels, gasoline, etc., from a fuel tank or reservoir to the injectors, fuel pressure regulators, return lines and ending up in combustion chambers and/or manifolds;

e. Ignition system components including, but not limited to coils, igniters, ignition pickups, magneto's, spark plugs and wires will ignite mixture of combustible charge injected into cylinders;

f. Electronic engine control unit (ECU) or computer, will monitor sensor outputs such as temperature(s), engine speed and other variables to thereby make calculations for optimal engine performance;

g. Various sensors including but not limited to throttle position, intake air temperature, engine water temperature, cylinder head temperature, knock, fuel temperature, manifold pressure and crank position sensor; and h. A wiring harness that will connect the various sensors pickups, etc., to the engine management system.

Please note that in some applications, an intake manifold and throttle bodie(s) may be included due to engine requirements.

This system may also use manifolds, carburetors and various other components from original application, if necessary. The charging system components may be changed or upgraded, as necessary. Further, some or possibly all of the system components will be sealed from the environment.

The invention employs use of combinations of typical components delineated above to control the operation of an engine. An engine management computer processing/control device or Electronic Engine Control Unit, typically known as an "ECU", will gather data from various sensors or pick-ups attached to the engine. The ECU will determine load, crank position and rpm (revolutions per minute) at which point a calculation will be made. The ECU will then send output signals to other components. As the engine rotates, it creates vacuum or suction, which is measured by a manifold absolute pressure sensor. A throttle position sensor tells the ECU the size of the throttle opening, an air temperature sensor measures the temperature of the incoming air charge to assist determining the air's density. Depending on engine rpm, temperature and other variables, fuel will be injected via injectors, either mounted on the intake manifold, on or in the cylinder head. The piston compresses this air and fuel charge, which is then ignited by spark plugs with voltage created by the coils or magneto's. This system will, by accurately measuring the engine's requirements, make management decisions and thereby increase power output, reduce fuel consumption, reduce emissions output, and ultimately create a better running engine. It is anticipated that this system can be adapted to be used as original equipment and in a retrofit kit form for current carbureted or fuel injected engines.

DETAILED DESCRIPTION OF THE INVENTION

Figure 1:
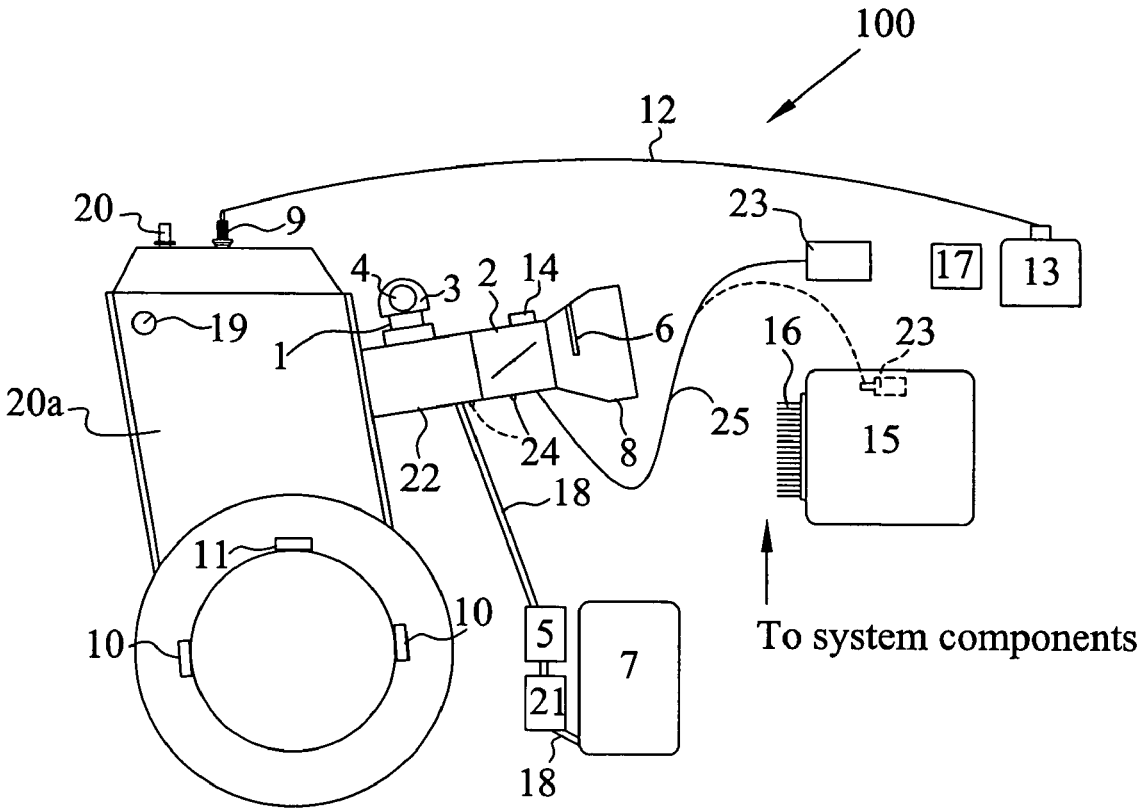
FIG. 1 is a conceptual schematic drawing of one example of the invention, including its typical components.

Referring now to the drawing, FIG. 1 is a conceptual schematic drawing of the major components of the invention, which is a fuel injection system to be used as an original equipment manufactured system in new two-cycle engines or as a kit for retrofitting existing two-cycle engines, and is depicted generally as 100.

The enumerated parts or components noted on FIG. 1 are as follows:

1. Fuel Injectors;
2. Throttle Body;
3. Fuel Rail;
4. Fuel Pressure Regulators;
5. Fuel Pump;
6. Air Thermo Sensor;
7. Fuel Tank;
8. Air Box;
9. Spark Plug(s);
10. Magnet(s);
11. Pickup(s);
12. Spark Plug Wire;
13. Coil;
14. Throttle Position Sensor (TPS);
15. Electronic Engine Control Unit (ECU);
16. Wire Harness;
17. Igniter;
18. Fuel Lines;
19. Water Temperature Sensor;
20. Cylinder Head Temperature Sensor;

20*a*. Cylinder;
21. Fuel Filter;
22. Intake Manifold;
23. Map Sensor;
24. Manifold Pressure Port; and
25. Map Sensor Hose.

Although fuel injectors 1 are conceptually shown on FIG. 1 as located in intake manifold 22, it is understood that the injectors 1 may be instead located on the cylinder head itself.

The invention is a fuel injection system 100 for two-cycle engines comprising high pressure fuel injectors adapted to be installed in a two-cycle gas engine assembly.

Typical components include a high pressure fuel pump 5; a fuel pressure regulator 4 to set and vary fuel pressures as necessary; fuel lines 18 to allow transfer of fuels, gasoline, etc., from a fuel tank or reservoir 7 through a fuel filter 21 and pump 5 to the injectors 1, return lines and ending up in combustion chambers and/or manifolds 22, fuel rail 3 or the cylinder head 20*a* itself; ignition system components including, but not limited to coils 13, igniters 17, ignition pickups 11, magneto's 10, spark plugs 9 and wires 12 will ignite mixture of combustible charge injected into cylinders; electronic engine control unit (ECU) or computer 15, to monitor sensor outputs such as temperature(s), engine speed and other variables to thereby make calculations for optimal engine performance; various sensors including but not limited to throttle position 14, intake air temperature 6 at air box 8, engine water temperature 19, cylinder head temperature 20, knock, fuel temperature, manifold pressure and crank position sensor; and a wiring harness 16 that will connect the various sensor pickups, etc., to the engine management system 15.

More particularly, the invention is a fuel injection system 100 adapted to be used in a fuel charging system in a two-cycle engine assembly. It comprises fuel injectors 1 adapted to provide injected fuel on demand for combustion by the two-cycle engine assembly.

The invention further comprises means for monitoring desired operating parameters for calculating optimal engine performance and for controlling the injection of fuel for said combustion. Typically this can be provided by a processor that is programmed such as an electronic engine control/processing unit or ECU 15, similar to those used in automobiles.

The inventive system includes sensors for monitoring said operating parameters, including a temperature of an incoming air (sensor 6), an engine speed (sensors 10, 11), an engine water temperature (sensor 19), a cylinder head temperature (sensor 20), a fuel temperature, and a crank shaft position (sensors 10, 11).

When applicable, the system includes sensors for monitoring a throttle body position (sensor 14) and a manifold pressure (sensor 23).

The system further includes means for setting and varying fuel pressures as necessary, acting as a fuel pressure regulator 4, designed to set base fuel pressure and to vary pressure by charge voltage sensed at the magneto and ultimately varying pressure and volume by changing pump speed.

The fuel injectors 1 are adapted to be installed in either a fuel injector holder or fuel rail 3, a manifold 22, a cylinder 20*a* and any combination thereof depending on the configuration of the two-cycle engine assembly. These enumerated features are depicted conceptually on FIG. 1 only.

The two-cycle engine assembly typically includes a fuel pump 5 capable of accommodating fuel injectors 1; a fuel pressure regulator 4 to set and vary fuel pressures as necessary; fuel lines 18 adapted to transfer fuel from a fuel tank 7 to said fuel injection system 100; and an ignition system. The two-cycle engine assembly also typically includes an intake manifold 22 and/or a throttle body 2.

As shown in FIG. 1, the map sensor 23 may be a separate unit r it may be built into the ECU 15. Also, the manifold pressure port 24 may be located in he throttle body 2 or alternatively in the intake manifold 22.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention.

What is claimed is:

1. A system for increasing power output, improving efficiency and lowering emission outputs during operation of two-cycle engines, the system comprising:

a fuel injection system adapted to be used in a fuel charging system in a two-cycle engine assembly;

fuel injectors adapted to provide injected fuel on demand for combustion during operation by the two-cycle engine assembly;

means for monitoring desired operating parameters for calculating optimal engine performance and for controlling the injection of fuel for said combustion, wherein said means for monitoring the desired operating parameters for calculating optimal engine performance and for controlling the injection of the fuel for said combustion is an electronic engine control/processing unit;

sensors for monitoring said operating parameters; and means for setting and varying fuel pressures as necessary during operation of said two-cycle engine assembly, said means for setting and varying fuel pressures as necessary being a fuel regulator, in which said fuel pressure is varied from an initial setting by a charge voltage sensed at the magneto wherein a pressure and volume are varied by changing pump speed.

2. The system according to claim 1, wherein the sensors for monitoring said operating parameter monitor a temperature of an incoming air, an engine speed, an engine water temperature, a cylinder head temperature, and a crank position.

3. The system according to claim 2, wherein said sensors for monitoring said operating parameters further comprise:

sensors for monitoring a throttle position and a manifold pressure.

4. The system according to claim 1, wherein the fuel injectors are adapted to be installed in one of a fuel rail or injector holder, a manifold, a cylinder and any combination thereof.

5. The system according to claim 1, wherein said two-cycle engine assembly comprises:

a fuel pump capable of accommodating fuel injectors;

a fuel pressure regulator to set and vary fuel pressures as necessary;

fuel lines adapted to transfer fuel from a fuel tank to said fuel injection system; and an ignition system.

6. The system according to claim 5, wherein said two-cycle engine assembly further comprises:

an intake manifold and/or a throttle body.

* * * * *